United States Patent [19]

Graf

[11] 4,162,747

[45] Jul. 31, 1979

[54] REFILL CONTAINER FOR PUMPABLE ACTIVE INGREDIENTS OF WASHING AGENTS

[75] Inventor: Richard Graf, Berlin, Fed. Rep. of Germany

[73] Assignee: Bosch Siemens Hausgeräte GmbH, Stuttgart, Fed. Rep. of Germany

[21] Appl. No.: 789,620

[22] Filed: Apr. 21, 1977

[30] Foreign Application Priority Data

May 18, 1976 [DE] Fed. Rep. of Germany ..... 2622125

[51] Int. Cl.[2] ..... B67D 3/00

[52] U.S. Cl. ..... 222/185; 222/484; 222/510

[58] Field of Search ..... 222/185, 325, 510, 484; 134/93, 100, 101

[56] References Cited

U.S. PATENT DOCUMENTS

| | | | |
|---|---|---|---|
| 1,463,415 | 7/1923 | Younger | 222/510 X |
| 1,761,931 | 6/1930 | McKinley | 222/510 X |
| 2,318,635 | 5/1943 | Salinger | 222/383 X |
| 3,392,885 | 7/1968 | Meyerhoefer | 222/510 X |
| 3,399,808 | 9/1968 | Bucy | 222/380 X |
| 3,826,408 | 7/1974 | Berndt et al. | 222/70 |
| 4,018,363 | 4/1977 | Cassia | 222/325 X |

FOREIGN PATENT DOCUMENTS

| | | | |
|---|---|---|---|
| 188026 | 9/1921 | United Kingdom | 222/510 |

*Primary Examiner*—Robert J. Spar
*Assistant Examiner*—Francis J. Bartuska
*Attorney, Agent, or Firm*—Herbert L. Lerner

[57] ABSTRACT

Refill container for pumpable active ingredients of washing agents to replenish washing agents in supply receptacles in a washing machine, in which the refill container has a pouring spout which has a shape and size to fit the filling opening of the supply receptacle and can be tightly but detachably connected to the filling opening.

1 Claim, 1 Drawing Figure

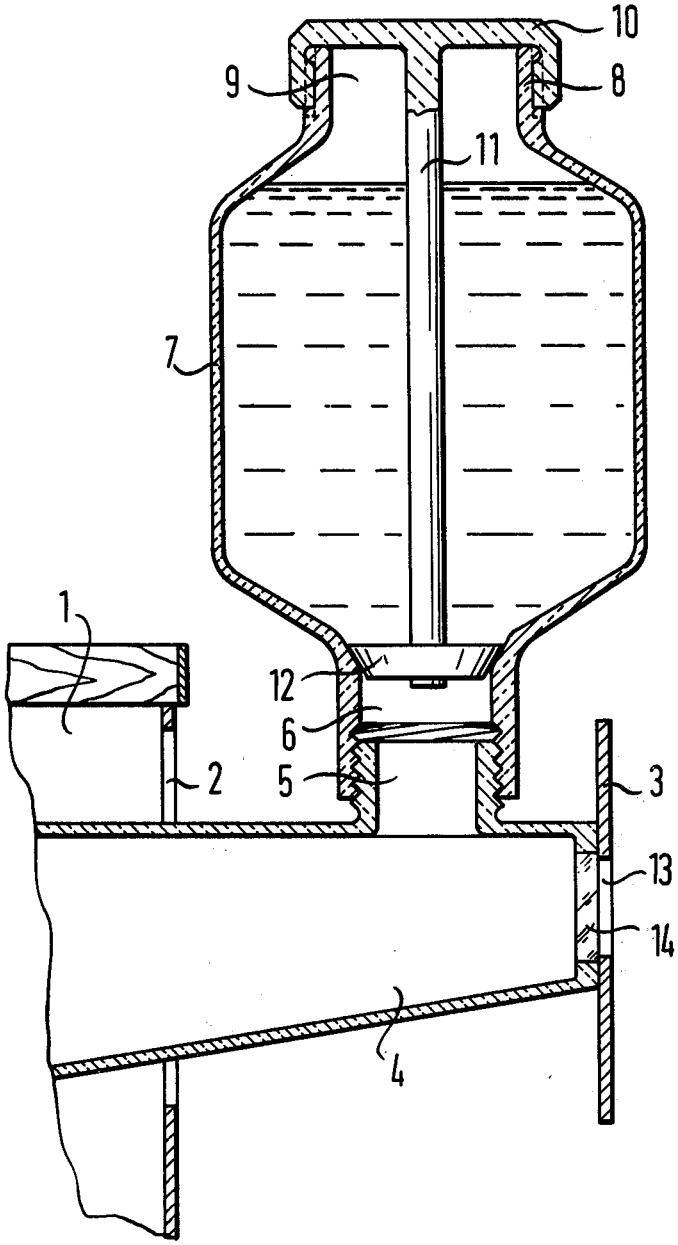
10
9
8
11
7
1
12
6
2
5
3
13
14
4

REFILL CONTAINER FOR PUMPABLE ACTIVE INGREDIENTS OF WASHING AGENTS

BACKGROUND OF THE INVENTION

1. Field of the Invention

This invention relates to a refill container or replenishing tank for pumpable washing agents which are stored in supply receptacles with filling openings in a machine for cleaning household articles and can be conducted at the proper time into the cleaning chamber of the machine by pumping devices.

2. Description of the Prior Art

It becomes increasingly clear that washing agents that can be pumped and metered will be used in the future for household cleaning purposes. Preliminary machine design concepts have already been developed which are based on the use of agents that can be pumped. Metering devices for such agents have also been developed, so that there are hardly any basic obstacles in the way to the widespread application of the mutually complementary machine components. On the other hand, the use of pumpable (liquid, pulpy, pasty) washing agents in the household raises several problems. In preparation for washing methods which are as economical and environment-compatible as possible, it will be necessary to keep the heretofore known packaged washing agent combinations in readiness as individual washing agents or as less elaborate combinations of such agents. Certain agents may be offered in such a concentration that irritation could be caused upon contact with the human skin. Also, it is important that certain washing agents be prevented from being filled by mistake into supply receptacles of the machine not intended for them.

SUMMARY OF THE INVENTION

With the foregoing and other objects in view, there is provided in accordance with the invention a refill container for pumpable active ingredients of washing agents to replenish washing agents stored in supply receptacles with filling openings in a washing machine for cleaning household articles which washing agents can be conducted into the cleaning chamber of the washing machine by pump devices, including a refill container having a pouring spout, the shape and size of which fits exactly the shape and size of the filling opening of the supply receptacle of the washing machine and has means for tightly but detachably connecting the pouring spout to the filling opening.

There is provided in accordance with the invention a refill container which has a filling and venting opening for filling the refill container when empty and for venting the refill container when emptying its contents to refill the supply receptacle, and the refill container has a closing device which simultaneously closes the filling and venting opening and the discharge opening of the pouring spout.

In a preferred embodiment the filling and venting opening and the pouring spout opening are lined up opposite each other and the filling and venting opening has a threaded nozzle and a screw cap which closes-off the filling and venting opening, and the screw cap has a stay extending into the refill container to a disk plug which closes-off the opposite pouring spout opening from the inside.

Other features which are considered as characteristic for the invention are set forth in the appended claims.

Although the invention is illustrated and described herein as embodied in a refill container for pumpable active ingredients of washing agents, it is neverthelss not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing, which diagrammatically illustrates in partial section the refill container in accordance with the invention and the upper front edge of a washing machine with the pouring spout of the refill container attached to the filling opening of the supply receptacle of the machine.

DETAILED DESCRIPTION OF THE INVENTION

The refill container or replenishing tank has a spout with a shape and size which fits exactly the shape and size of the replenishing or filling opening of the supply receptacle and can be connected to the replenishing opening tightly but detachably. Thus the spout is of such shape and size that it will mate only with a filling opening for which it was designed and not with other filling openings. In accordance with the invention, a form of shipping container is made available to washing agent manufacturers, which may be kept in a household and used as a refill container to a supply receptacle which is almost foolproof for the user as well as for the machine. The user is prevented by virtue of the refill container in accordance with the present invention from pouring a washing agent by mistake into a supply receptacle of the machine not intended for it and from accidentally pouring out an uncontrolled amount if an open refill container is knocked over.

In the drawing is shown in cross section the upper front edge of a laundry treatment machine 1 by way of example. On the front side, this laundry treatment machine 1 may have several cutouts 2 which are normally covered up or filled out by shutters 3. The shutter 3 can be hinged to the front side of the machine housing or may be firmly connected to a pull-out replenishing stub 4 which has on its top side a replenishing nozzle 5 with external thread.

A refill container is screwed onto this replenishing nozzle 5 by means of pouring spout 6. The pouring spout 6 is a tubular nozzle which carries an internal thread fitting the external thread of the replenishing nozzle 5. The refill container furthermore consists of a hollow body 7, the shape and volume of which can be varied. A threaded nozzle 8 of a filling and venting opening 9 is provided on the side of the hollow body 7 opposite the pouring spout 6. The threaded nozzle 8 carries on its outside a screw cap 10 closing the filling and venting opening. In the example shown, the pouring spout 6 and the filling and venting opening 9 are lined up opposite each other. At the underside of the screw cap 10, a disk plug 12 is arranged by means of a long stay or brace 11 (a rod or bar connecting screw cap 10 with disk plug 12) coaxially with and at such a distance from the former that the disk plug 12 closes the pouring spout 6 tightly if the screw cap 10 is screwed on. The sealing surfaces are designed to automatically center the disk plug 12 in the pouring spout 6 when the filling and venting opening 9 is closed. Preferably, cones as shown in the drawing are used.

The diameter of the disk plug 12 can be kept smaller than the diameter of the filling and venting opening 9. If, on the other hand, the diameter of the filling and venting opening 9 is kept slightly smaller than the diameter of the disk plug 12, then the latter can be pushed through the filling and venting opening 9 with relatively little force after the replenishing tank is filled and can then no longer get lost. The subsequent pushing-in of the disk plug 12 can further be facilitated by making the rim of its largest diameter semi-elastic.

A refill container according to the invention can be fabricated in a particularly advantageous manner by a blowing process known in plastics technology as blow molding from any suitable thermoplastic material.

The shutter 3 at the front end of the replenishing stub 4 can be provided for observing the level of washing agent content in the supply receptacle, for instance, by means of a cutout 13, behind which a viewing glass 14 is arranged which seals the wall of the replenishing stub 4 tightly.

The invention is not limited to the embodiment example shown. It is also possible to use a refill container which has only one opening which is used in one case as the filling opening and in the other case as the pouring-out opening. However, it is then advantageous to make the filling opening for the supply tank arranged in the machine rotatable in such a manner that, for connecting the replenishing tank to the filling opening, the pouring opening of the refill container points up and thereby, the contents are prevented from flowing out. After the refill container is connected to the filling opening, the refill container can be rotated into an upside-down position. If the refill container consists of a soft, elastic material, the discharge of its content can be aided by pressing the refill container. For venting the empty container, a venting opening can be provided in this case at the filling canal of the machine.

Other forms may also be provided for filling containers, particularly also in the case of filling containers which have separate openings for filling and pouring-out, which, if equipped, can be arranged opposite each other in non-aligned condition. The example shown, however, is the preferred embodiment.

There is claimed:

1. The refill container for pumpable active ingredients of washing agents to replenish washing agents stored in supply receptables with filling openings in a washing machine for cleaning household articles which washing agents can be conducted into the cleaning chamber of the washing machine by pump devices, comprising a non-collapsible fill container having a pouring spout, the shape and size of which fits exactly the shape and size of the filling opening of the supply receptable of the washing machine and has means for tightly but detachably connecting the pouring spout to the filling opening whereby the refill container is temporarily attached to the filling opening to empty its contents into the supply receptacle of the washing machine and whereby by virtue of the pouring spout fitting exactly the shape and size of the filling opening, ensuring that the contents of the container enter the supply receptable intended for it, wherein said refill container has a filling and venting opening for filling said refill container when empty and for venting said refill container when emptying its contents to refill said supply receptable, and said refill container has a closing device which simultaneously closes said filling and venting opening and the discharge opening of said pouring spout, and wherein the filling and venting opening and the pouring spout opening are lined up opposite each other and wherein the filling and venting opening has an externally threaded nozzle and whereby a screw cap extends over and closes-off said filling and venting opening, and wherein said screw cap has a stay extending into said refill container to a disk plug which closes off the opposite pouring spout opening from the inside.

* * * * *